US005400230A

United States Patent [19]

Nicoletti

[11] Patent Number: 5,400,230

[45] Date of Patent: Mar. 21, 1995

[54] PILLOW LIGHT

[76] Inventor: Leonard D. Nicoletti, P.O. Box 20951, Philadelphia, Pa. 19141-0951

[21] Appl. No.: 161,587

[22] Filed: Dec. 6, 1993

[51] Int. Cl.[6] ..... F21V 33/00

[52] U.S. Cl. ..... 362/253; 362/189; 362/390; 5/639

[58] Field of Search ..... 362/130, 189, 234, 253, 362/390, 801; 5/639

[56] References Cited

U.S. PATENT DOCUMENTS 4,480,294 10/1984 Carboni ..... 362/189 X 4,972,533 11/1990 Brown ..... 362/800 X 5,066,012 11/1991 Stark ..... 362/390 X

*Primary Examiner*—Stephen F. Husar

*Attorney, Agent, or Firm*—Michael I. Kroll

[57] ABSTRACT

A pillow light is provided and consists of a flashlight assembly and a very soft casing sealed about the flashlight assembly. The flashlight assembly with the very soft casing can be inserted between a pillowcase and a pillow on a bed and not disturb a person resting their head on the pillowcase. In the event of a power failure and other emergencies the pillow light will be at hand for a dependable light source.

14 Claims, 3 Drawing Sheets

PILLOW LIGHT

BACKGROUND OF THE INVENTION

1. Field of the Invention

The instant invention relates generally to flashlights and more specifically it relates to a pillow light.

2. Description of the Prior Art

Numerous flashlights have been provided in prior art that are adapted to be small portable lamps powered by batteries. While these units may be suitable for the particular purpose to which they address, they would not be as suitable for the purposes of the present invention as heretofore described.

SUMMARY OF THE INVENTION

A primary object of the present invention is to provide a pillow light that will overcome the shortcomings of the prior art devices.

Another object is to provide a pillow light that is specifically designed to be placed in a pillowcase on a bed, so that in the event of a power failure and other emergencies, it will be at hand for a dependable light source.

An additional object is to provide a pillow light that is lightweight, compact and has a very soft casing thereabout, so that it can be placed inside the pillowcase to be taken out and used, especially by a child and an elderly person.

A further object is to provide a pillow light that is simple and easy to use.

A still further object is to provide a pillow light that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
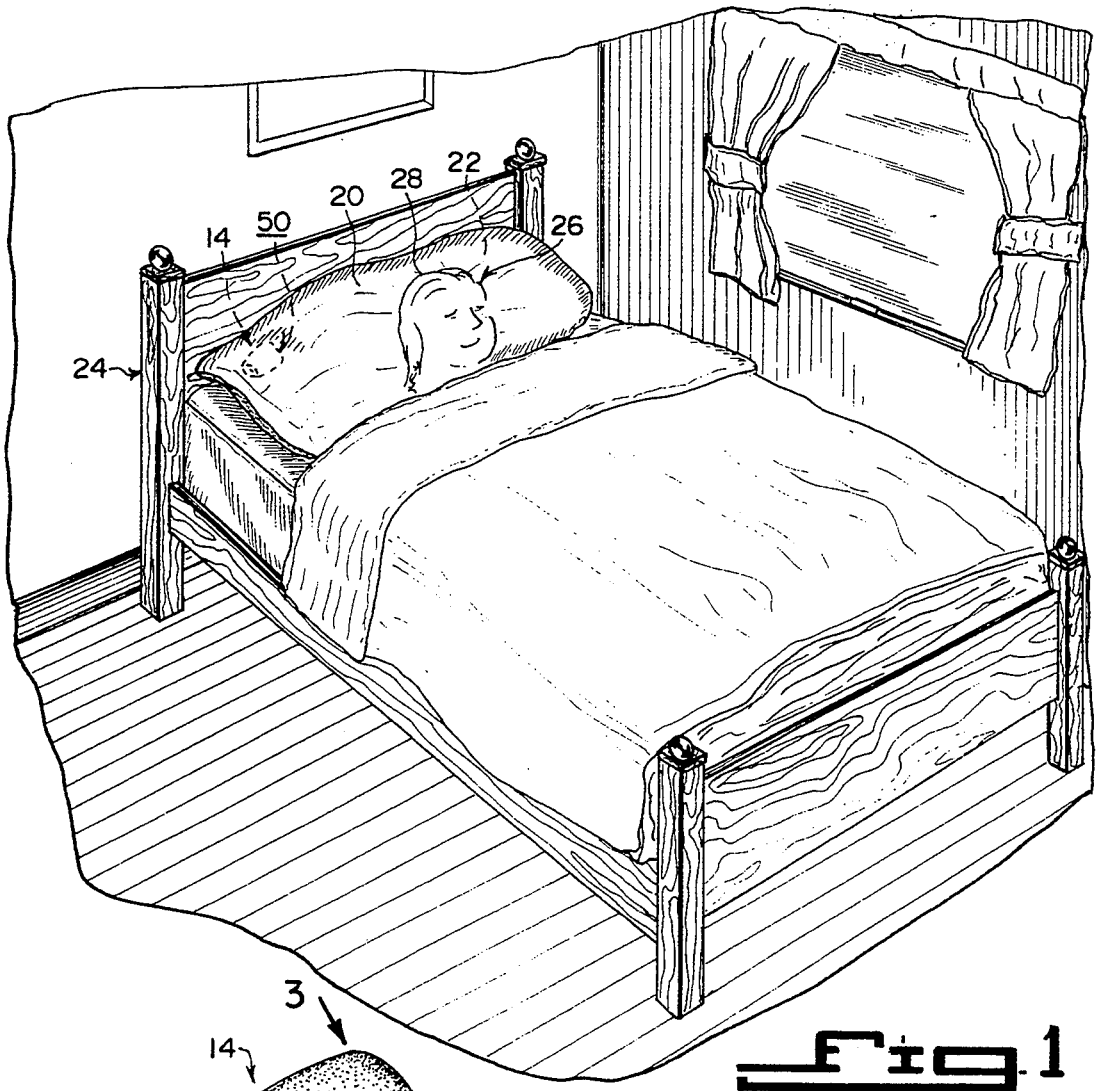
FIG. 1 is a perspective view showing the first embodiment of the instant invention inserted within a pillowcase on a bed.
Figure 2:
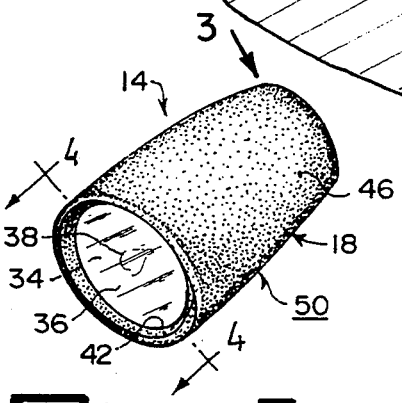
FIG. 2 is a front perspective view of the first embodiment per se being barrel shaped.

Turning now descriptively to the drawings, in which similar reference characters denote similar elements throughout the several views, FIGS. 1 through 12 illustrate a pillow light 14, which consists of a flashlight assembly 16 and a very soft casing 18 sealed about the flashlight assembly 16. The flashlight assembly 16 with the very soft casing 18 can be inserted between a pillowcase 20 and a pillow 22 on a bed 24 and not disturb a person 26 resting their head 28 on the pillowcase 20. In the event of a power failure and other emergencies, the pillow light 14 will be at hand for a dependable light source.

The flashlight assembly 16 includes a housing 30, with at least one battery 32 connected to an electric circuit in the housing 30. A reflector 34 is in the housing 30, while a lens 36 is over the reflector 34 on the housing 30. A light bulb 38 is mounted in the reflector 34 and is connected to the electric circuit. A switch 40 on the housing 30 is connected to the electric circuit. The very soft casing 18 has a first opening 42 therein, so as to expose the lens 36 and a second opening 44, so as to expose the switch 40.

Figure 5:
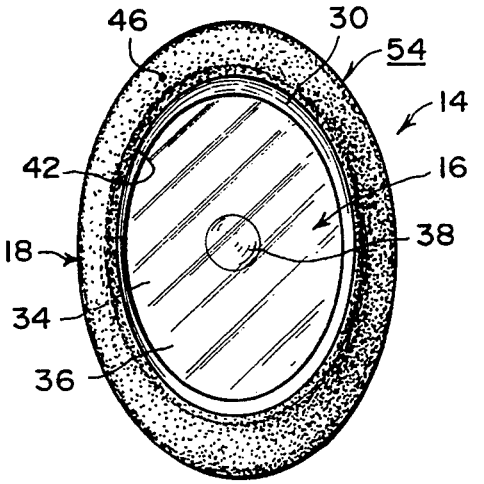
FIG. 5 is a front view taken in direction of arrow 5 in FIG. 4 of a third embodiment being oval shaped.
Figure 6:
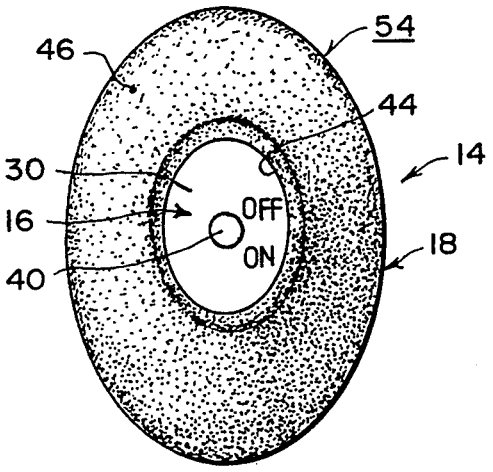
FIG. 6 is a rear view taken in the direction of arrow 6 in FIG. 4 of the third embodiment.
Figure 7:
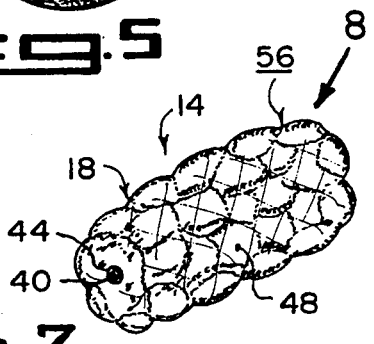
FIG. 7 is a rear perspective view of a fourth embodiment being cylindrical shaped with a quilted padding casing.
Figure 8:
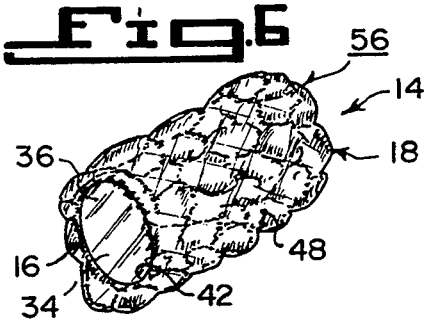
FIG. 8 is a front perspective view taken in the direction of arrow 8 in FIG. 7.

As best seen in FIGS. 2 to 6 and 9 to 12, the very soft casing 18 is fabricated out of a foam padding 46. In FIGS. 7 and 8, the very soft casing 18 is fabricated out of a quilted padding 48.

Figure 3:
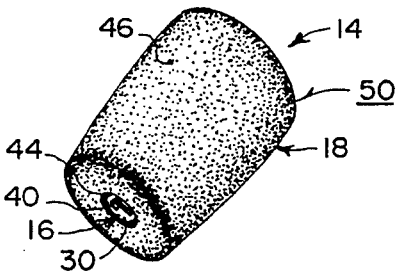
FIG. 3 is a rear perspective view taken in the direction of arrow 3 in FIG. 2.
Figure 4:
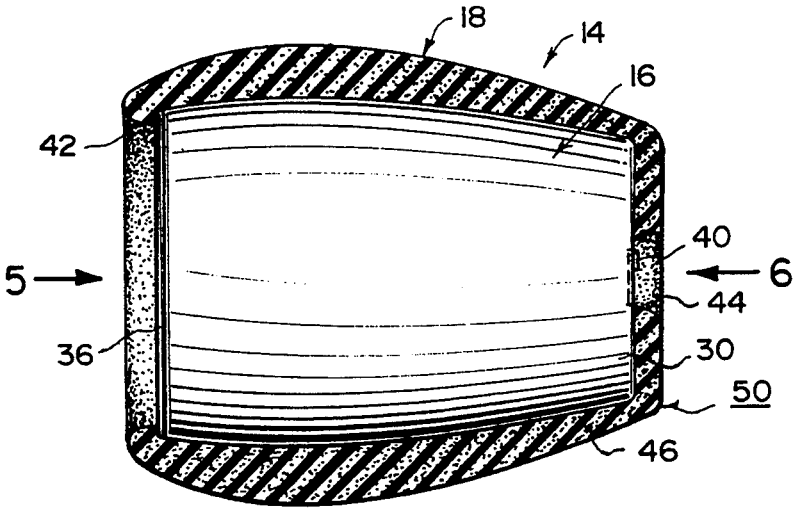
FIG. 4 is a cross sectional view taken along line 4—4 in FIG. 2 of the first embodiment.

The switch 40 can be a slide switch, as shown in FIG. 3 and 4. The switch 40 can also be a push button switch, as shown in FIGS. 6, 7, 10 and 11.

Figure 3A:
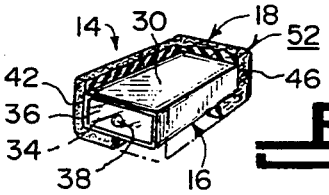
FIG. 3A is a front perspective view with parts broken away of a second embodiment being rectangular shaped.

In FIGS. 1, 2, 3 and 4, the housing 30 and the very soft casing 18 are in a barrel shaped configuration 50. In FIG. 3A the housing 30 and the very soft casing 18 are in a rectangular shaped configuration 52. In FIGS. 5 and 6, the housing 30 and the very soft casing are in an oval shaped configuration 54. In FIGS. 7 and 8, the housing 30 and the very soft casing 18 are in a cylindrical shaped configuration 56.

Figure 9:
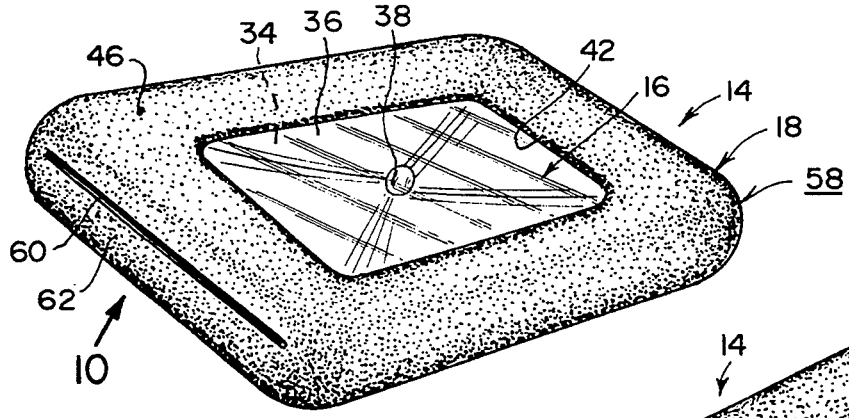
FIG. 9 is a front perspective view of a fifth embodiment being compact rectangular shaped.
Figure 10:
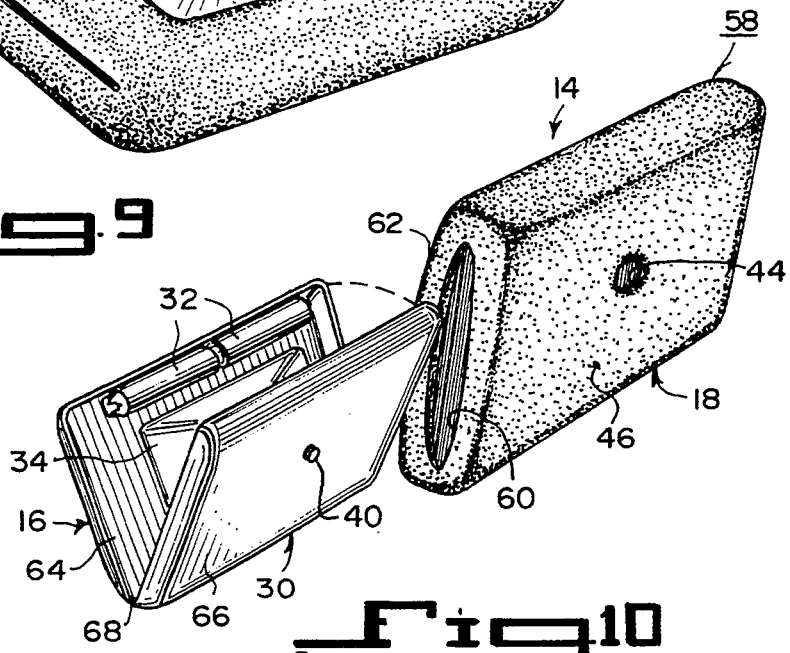
FIG. 10 is a rear perspective view taken in the direction of arrow 10 in FIG. 9, showing the compact type housing of the light removed from the casing and partly opened.

In FIGS. 9 and 10, the housing 30 and the very soft casing 18 are in a rectangular compact shaped configuration 58. The very soft casing 18 has a resealable pocket 60 in one side 62 thereof and the housing 30 is split into two segments 64 and 66, that are hinged together at 68. The housing 30 when closed can be inserted into the very soft casing 18 through the resealable pocket 60.

Figure 11:
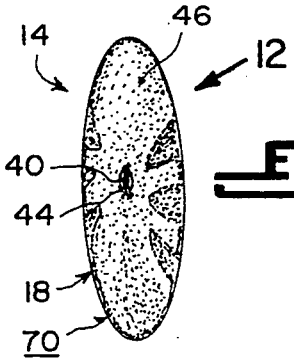
FIG. 11 is a rear perspective view of a sixth embodiment being dish shaped.
Figure 12:
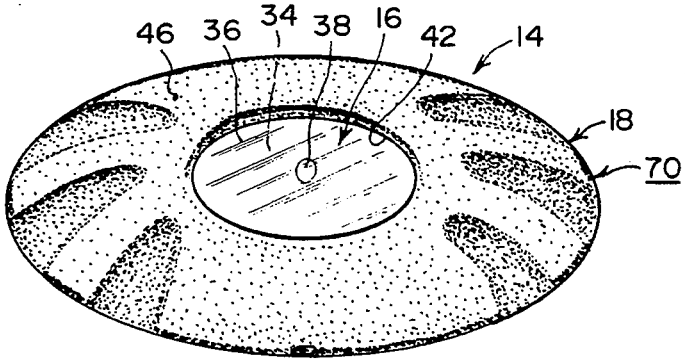
FIG. 12 is a front perspective view taken in the direction of arrow 12 in FIG. 11.

In FIGS. 11 and 12, the housing 30 and the very soft casing 18 are in a dish shaped configuration 70.

OPERATION OF THE INVENTION

To use the pillow light 14 the following steps should be taken:

1. Place the very soft casing 18 about the housing 30 of the flashlight assembly 16.

2. Make sure that the first opening 42 exposes the lens 36 and that the second opening 44 exposes the switch 40.
3. Put the switch 40 in its off position.
4. Insert the pillow light 14 between the pillowcase 20 and the pillow 22 in one corner thereof.
5. Use the pillow 22 with the pillowcase 20 as you normally would when you go to sleep.
6. If there is a power failure and any other emergency the pillow light 14 is at hand.
7. Remove the pillow light 14 from the pillowcase.
8. Put the switch 40 in its on position, to cause the light bulb 38 to illuminate.

LIST OF REFERENCE NUMBERS

14 pillow light
16 flashlight assembly
18 very soft casing
20 pillowcase
22 pillow
24 bed
26 person
28 head of 26
30 housing
32 battery
34 reflector
36 lens
38 light bulb
40 switch
42 first opening in 18
44 second opening in 18
46 foam padding of 18
48 quilted padding of 18
50 barrel shaped configuration
52 rectangular shaped configuration
54 oval shaped configuration
56 cylindrical shaped configuration
58 rectangular compact shaped configuration
60 resealable pocket in 62
62 one side of 18
64 first segment of 30
66 second segment of 30
68 hinge
70 dish shaped configuration It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A pillow light which comprises:
a) a flashlight assembly; and
b) a very soft casing sealed about said flashlight assembly in which said flashlight assembly with said very soft casing can be inserted between a pillowcase and a pillow on a bed and not disturb a person resting their head on the pillowcase, whereby in the event of a power failure and other emergencies, said pillow light will be at hand for a dependable light source.

2. A pillow light as recited in claim 1, wherein said flashlight assembly includes:
a ) a housing;
b) at least one battery connected to an electric circuit in said housing;
c) a reflector in said housing;
d) a lens over said reflector on said housing;
e) a light bulb mounted in said reflector and connected to said electric circuit; and
f) a switch on said housing connected to said electric circuit.

3. A pillow light as recited in claim 2, further including:
a) said very soft casing having a first opening therein, so as to expose said lens; and
b) said very soft casing having a second opening therein, so as to expose said switch.

4. A pillow light as recited in claim 3, wherein said very soft casing is fabricated out of a foam padding.

5. A pillow light as recited in claim 3, wherein said very soft casing is fabricated out of a quilted padding.

6. A pillow light as recited in claim 3, wherein said switch is a slide switch.

7. A pillow light as recited in claim 3, wherein said switch is a push button switch.

8. A pillow light as recited in claim 3, wherein said housing and said very soft casing are in a barrel shaped configuration.

9. A pillow light as recited in claim 3, wherein said housing and said very soft casing are in a rectangular shaped configuration.

10. A pillow light as recited in claim 3, wherein said housing and said very soft casing are in an oval shaped configuration.

11. A pillow light as recited in claim 3, wherein said housing and said very soft casing are in a cylindrical shaped configuration.

12. A pillow light as recited in claim 3, wherein said housing and said very soft casing are in a rectangular compact shaped configuration.

13. A pillow light as recited in claim 12, further including:
a) said very soft casing having a resealable pocket in one side thereof; and
b) said housing is split into two segments that are hinged together, so that said housing when closed can be inserted into said very soft casing through said resealable pocket.

14. A pillow light as recited in claim 3, wherein said housing and said very soft casing are in a dish shaped configuration.

* * * * *